United States Patent [19]

Wilkerson

[11] Patent Number: 4,741,072

[45] Date of Patent: May 3, 1988

[54] RAILROAD TRACK CLEANER

[76] Inventor: Kenneth R. Wilkerson, 487 Huron, Irvington, Ill. 62848

[21] Appl. No.: 15,796

[22] Filed: Feb. 17, 1987

[51] Int. Cl.[4] ..... E01H 8/10

[52] U.S. Cl. ..... 15/312 R; 15/55; 15/340; 15/348

[58] Field of Search ..... 15/54, 55, 312 R, 340, 15/348

[56] References Cited

U.S. PATENT DOCUMENTS

| | | | |
|---|---|---|---|
| 1,085,676 | 2/1914 | Finch | 15/348 X |
| 1,255,519 | 2/1918 | Ellis | 15/340 X |
| 2,727,263 | 12/1955 | Dangremond et al. | 15/55 |
| 4,393,537 | 7/1983 | Reprogle et al. | 15/348 |

FOREIGN PATENT DOCUMENTS

| | | | |
|---|---|---|---|
| 1469255 | 1/1967 | France | 15/340 |

*Primary Examiner*—Chris K. Moore

*Attorney, Agent, or Firm*—Kalish & Gilster

[57] ABSTRACT

A railroad track cleaner of non-self-motivational character which comprises a frame carrying front and rear wheels for rail traverse. The frame contains a housing for a transversely disposed, rotatably mounted broom assembly in the forward portion thereof and an axially parallel, rotatable feed conveyor located upwardly and rearwardly of the broom assembly and having a central spacing. A flipper or particle impeller is provided within said feed conveyor central spacing in alignment with a debris discharge port formed in the overlying portion of the housing. An air inlet port is provided in the housing forwardly of said debris discharge port. The cleaner is detachably engageable at the rearward end thereof to an automotive vehicle for travel, which vehicle is provided with a debris receptacle connected to a conventional vacuum. A flexible conduit is provided for extension between said cleaner discharge port and said vehicle hopper for withdrawal by said vacuum of debris swept by said broom assembly. Ground sweeping blades are provided on opposite sides of said housing for optionally operating within the zones outwardly of the rails for directing contacted debris toward the line of travel of the driven cleaner.

18 Claims, 6 Drawing Sheets

RAILROAD TRACK CLEANER

BACKGROUND AND SUMMARY OF THE INVENTION

This invention relates in general to railroad track cleaning equipment, and, more particularly, to a compact, mobile cleaning unit suitable for propulsion by a detachably engaged automotive vehicle.

Heretofore there have been numerous efforts to provide railway track cleaners for the purpose of removing from the road bed the debris, such as sand, gravel, cinder, dirt, etc., which consistently packingly builds up both between the rails and outwardly thereof. Such prior efforts were developed to overcome the inefficient, uneconomical manual clearing which had been done previously by road gangs. However, the prior cleaners were relatively complex, costly structures which were either self-motivated, that is, self-sufficient, or constructed so as to form a component of a train of railway cars mounted on the rails for travel therealong. Such cleaners consistently integrally involved entirely mechanical means for attempting to effect debris dislodgment and removal.

Reference may be made to U.S. Pat. No. 2,505,501 which discloses a track cleaning car forming part of a locomotive-driven train and having a brush for sweeping debris forwardly, in the direction of travel, into a first elevating feed conveyor, thence onto a screw conveyor for delivery through gravity directly onto a second, forwardly located elevating conveyor for ultimate deposit in the same or adjacent car. The cleaning car of said patent was manifestly a most highly intricate structure, and one adapted for integration with compatible, associated railway cars and thus could not be easily transported from one operational location to another without rail travel of the entire train therebetween. The Donahue U.S. Pat. No. 2,550,979, although relating to a track sweeper generally for road bed dressing, that is, for distributing residual ballast, also is designed for transportability only upon railroad rails. Sweep units are mounted upon a specially constructed railway car carrying its own motor so that the same may be located at a preselected site only by rail travel without regard to the intervening distance or degree of difficulty in accessibility. Therefore, to overcome the time consumption for movement between treatment sites with all of the costly waste implicit therein, a multiplicity of such cars would have been required for treating simultaneously a plurality of mutually remote zones to avoid the critical down-time. Kling U.S. Pat. No. 2,748,720 discloses a self-motivated track cleaner unit which embodies within a single structure wheel means for engaging the rails and the ground adjacent thereto during operation. However, there are supported on the vehicle a multiplicity of conveyors, such as a screw conveyor, a feed conveyor, and an elevating conveyor so that all debris movement is only achieved mechanically. In view of the single purpose of this vehicle, the same is patently a most costly structure being without usefulness beyond its single purpose.

A railroad track sweeper is also shown in Kershaw U.S. Pat. No. 2,869,159 which is adapted primarily for removing ballast car drippings from between and alongside the rails. The sweeper of this patent also constitutes a railway vehicle containing motor means for effecting movement of the rail-engaging wheels and thus is entirely self-contained and totally dependent upon such rails for inter-operating site travel. The same also incorporates a transverse rotary broom for the purpose of throwing swept up loose materials forwardly over a transverse deflector and onto a conveyor for deposit on the road shoulders, as opposed to permanently clearing the track of the same. The track cleaning apparatus of Holley et al U.S. Pat. No. 3,426,379, although of more relatively recent vintage, still demonstrates the heretofore accepted reliance upon integrating the operating components upon a specially constructed railway car of such size and weight that it must perforce be moved from one treating area to another by rail travel alone regardless of the path that must necessarily be traversed between such areas. In this patent, debris is charged to the usual endless chain conveyor mounted on the car forwardly of a rotary brush unit for delivery to an integrated hopper and thence to a debris conveyor, whereby the self-motivated car constitutes a self-sufficient, integrated unit.

The present invention overcomes many disadvantages. In summary, the same constitutes a non-self-motivated compact, relatively lightweight, highly durable mobile unit adapted for detachable engagement to an independently constructed powered unit for travel. Such powered unit is an automotive vehicle designed for highway travel and thus is useful when not engaged to effect travel of the present mobile unit. The cleaner of the present invention contains a rotary broom assembly for dislodging debris between, and immediately outwardly of, and adjacent to, the rails of the road bed being treated and for facilitating withdrawal of the debris rearwardly within a receiving chamber which is subjected to the force of a vacuum for drawing the same directly, or as assisted by a transverse feed conveyor located rearwardly of the broom assembly, to a point spacedly from the unit for collection and ultimate disposition. Thus, the debris movement is effected by a vacuum so that heavy and costly lifting and elevating conveyors are obviated, thereby conducing to the lightweight and compactness of the cleaning unit. By reason of the light weight thereof, the same may be easily removed from the rails, as by conventional hoisting means, and carried by an over-the-road vehicle to the next operating area without having to be dependent upon rail movement. Said unit may be most economically employed by virtue of such facile transportability so that a single unit may be judiciously used to cover numerous treatment zones in a relatively short period of time and hence eliminate the need to resort to either a multiplicity of cleaning cars or to accept the costly, wasted time duration for travel between locations, all as requisite heretofore by prior art structures. Therefore it is an object of the present invention to provide a railway track bed cleaning unit which is mobile upon railway rails during operation but is of relatively light weight for ease of transport between operational sites by an independently constructed automotive vehicle.

It is another object of the present invention to provide a track cleaning unit of the type stated which does not contain locomotive means, being non-self-sufficient, and hence is entirely dependent upon detachable engagement to an extraneous vehicle for motivation, which latter need not be adapted for rail movement.

It is a further object of the present invention to provide a track cleaning unit of the character stated which is designed to clear the area between the rails as well as the ground containing the tie ends outwardly thereof and, if desired, the shoulder areas so that full clearance of a right of way is simultaneously achieved. It is a still further object of the present invention to provide a track cleaning unit of the present invention which is adapted for reliably providing debris withdrawal from the treated zones through utilization of suction so as to obviate the costly and less reliable use of a multiplicity of mechanical components such as lifting and elevating chain conveyors.

It is another object of the present invention to provide a track cleaning unit of the present invention which contains a paucity of moveable parts so as to be break-down resistant.

It is a further object of the present invention to provide a track cleaning unit of the present invention which is constructed of a limited number of wear-resistant components so as to be markedly durable in usage; which is adapted for trouble-free long wear; which is highly economical in manufacture and in operation; which is singularly effective in track clearance, being capable of covering up to forty-two inches beyond the tie ends; which may be assembled or disassembled in a minimum of time; and the operation of which eliminates the raising of dust.

DESCRIPTION OF THE PREFERRED EMBODIMENTS

Figure 1:
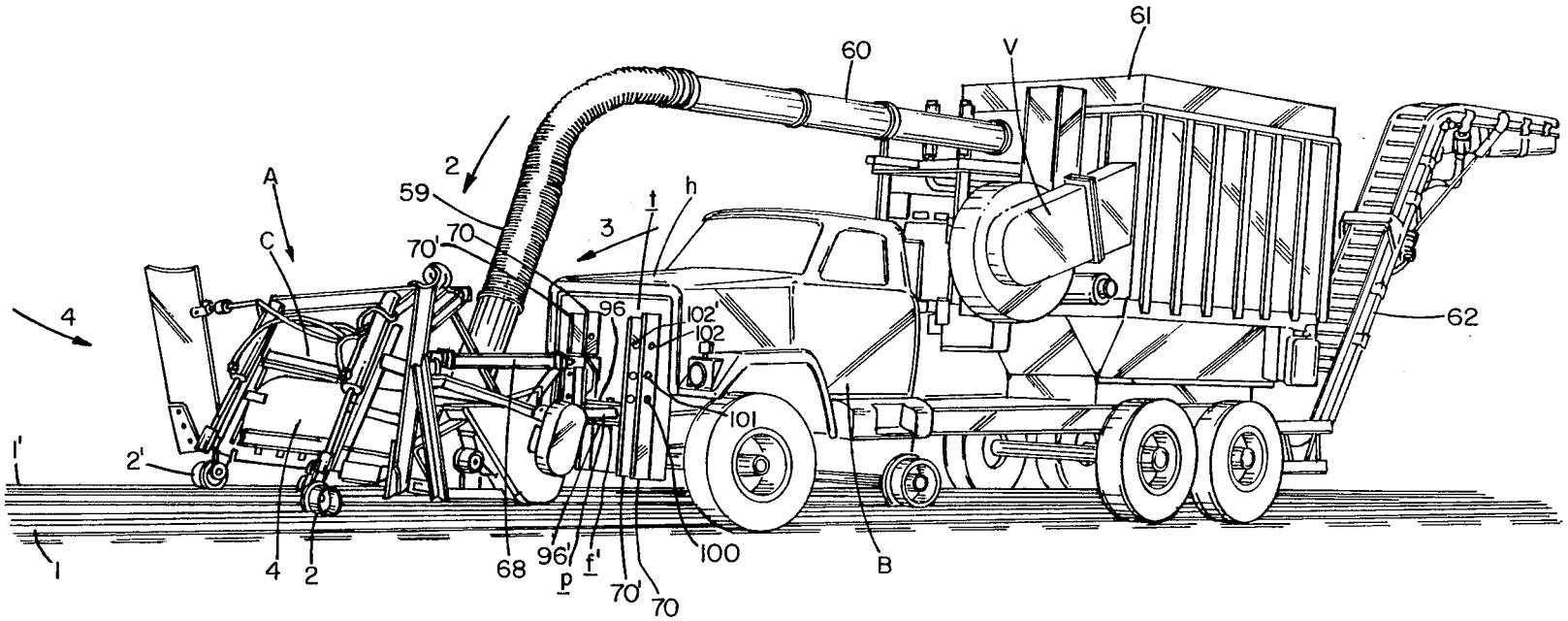
FIG. 1 is a perspective view of an automotive vehicle having attached thereto a railroad track cleaner constructed in accordance with and embodying the present invention for operational purposes.

Referring now by reference characters to the drawings which illustrate the preferred embodiment of the present invention, A generally designates a track cleaner for railroad beds; being mobile for travel along the customary rails 1, 1' of the bed being treated. Cleaner A is adapted for propulsion along rails 1, 1' by an automotive vehicle B to which cleaner A is detachably, operably engaged by means to be described. Thus, cleaner A is a compact, independently constructed, driven unit which does not constitute a part of a railroad car nor a component of a rail-supported train.

Cleaner A comprises a frame generally indicated at C which is composed of various structural elements more fully described hereinbelow; which frame is mounted upon a pair of flanged front wheels 2, 2' and rear wheels 3, 3' for engaging rails 1, 1', respectively.

Frame C supports a transversely extending housing 4, fabricated of suitable sheet stock of predetermined gauge for required strength, comprising side plates 5, 5', secured, as by welding, to a top plate 6 which in its forward portion is integral with a downwardly and forwardly arcuated front wall 7; and in its rearward portion curves downwardly and thence inwardly to define a rear wall 8 formed on a lesser radius than front wall 7, and being presented upwardly of the lower edges of side plates 5, 5'. Housing 4, which extends transversely of cleaner A is of such length that side plates 5, 5' are located laterally outwardly of the proximate rail 1, 1' respectively, and is open at the bottom thereof as at 9. Side plates 5, 5', top wall 6 with front and rear walls 7, 8 cooperate to define a downwardly opening chamber 10 having forward and rearward and communicating components 11, 12, respectively, for accomodating a broom assembly b and a debris screw-type, auger feed conveyor c.

Broom assembly b is constituted of a transversely extending shaft 13 which at its ends projects through side walls 5, 5' for journalling of the same within pillow blocks 14, 14' fixed upon angle members 15, 15' rigid with the outer face of the adjacent side wall 5, 5', respectively. Shaft 13 projects beyond pillow block 14' for carrying a sprocket 16 which is connected by means of a drive chain (not shown) to the drive shaft (not shown) of a hydraulic motor 17 suitably mounted on frame C. Internally of compartment 11, a sleeve 18 is carried upon shaft 13, being keyed or otherwise firmly engaged thereon, to which are affixed a plurality of radially-projecting, lengthwise extending mounting plates 19, being preferrably, but not necessarily, eight in number and arranged circumferentially about sleeve 18, with there being an angle of like extent between adjacent plates 19. Fixed upon each blade 19, as by bolting, is a multiplicity of U-clamps 20, may be in paired relationship, for reliably securing the inner ends of broom members 21 which extend radially of sleeve 18 and are slightly curvate at the free ends thereof, as at 22, the curvature being in the direction of travel of cleaner A. Each broom member 21 is fabricated of tough, wear-resistant material, being hard yet having adequate flexibility for resisting fracture upon striking an unyielding object, such as a deeply imbedded rock or the like. By means of U-clamps 20, broom members 21 are arranged in side-by-side relationship throughout substantially the entirety of the length of the related plate 19; with the exception of zones containing cut-out portions indicated at 23, 23' which are aligned with rails 1, 1' for effecting clearance thereof during the cleaning operation. Thus, broom members 21 located on the respective plate 19 between the adjacent end and the proximate cutout 23, 23', as the case may be, will thus necessarily be located laterally outwardly of rails 1, 1' during travel of cleaner A so as to engage the portion of the rail bed in the area of the tie ends; while the broom members 21 on each plate 19 located between the associated cutouts 23, 23' are presented for sweeping action with respect to the portion of the bed between rails 1, 1'.

Figure 4:
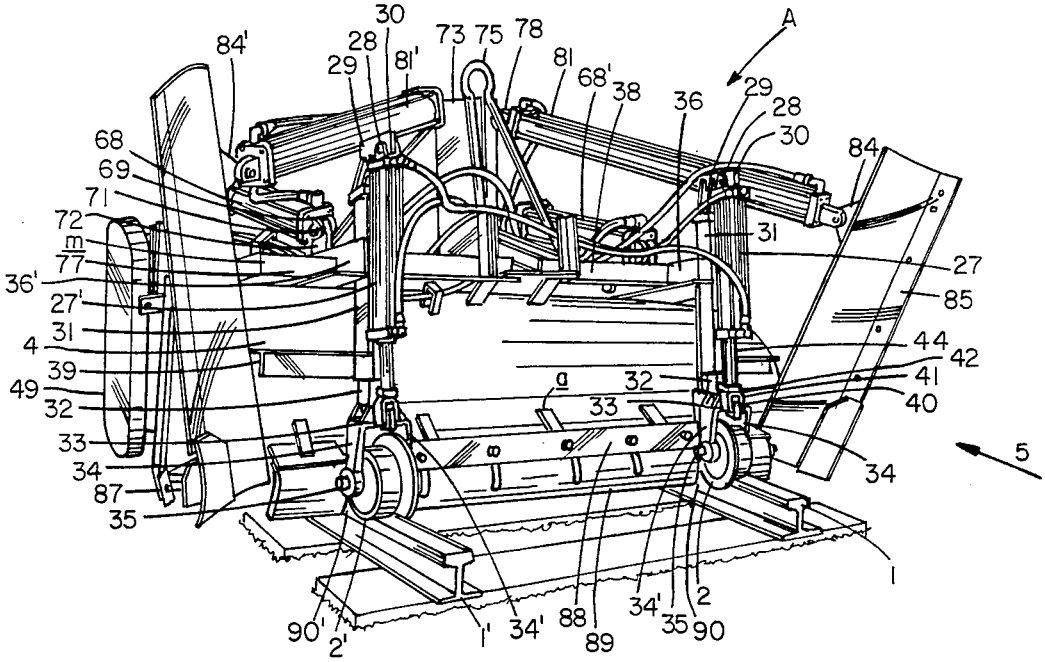
FIG. 4 is a perspective view looking at the forward end of the sweeper in the direction of the arrow at 4 in FIG. 1.
Figure 5:
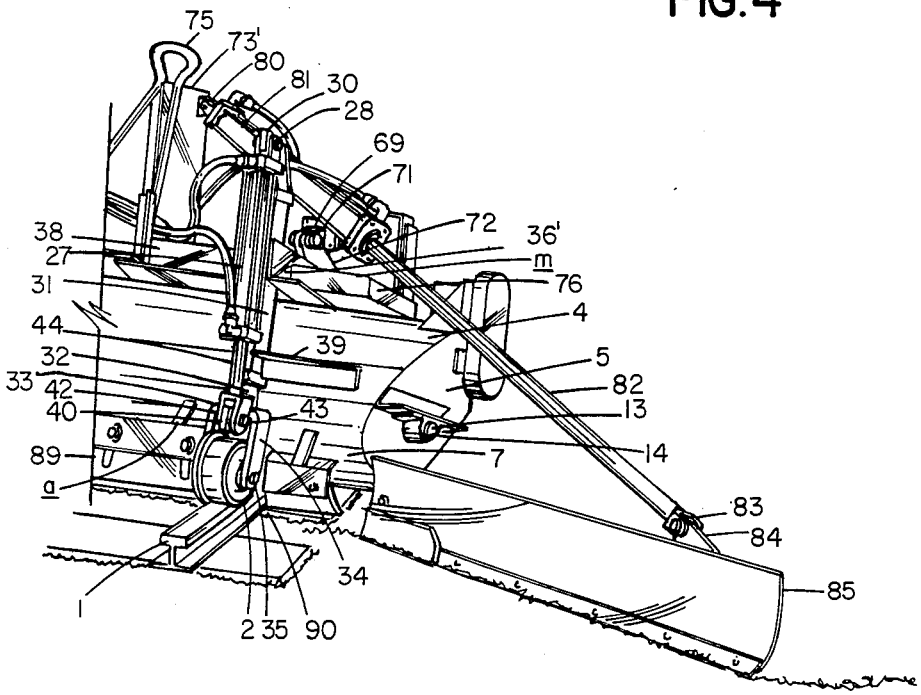
FIG. 5 is a perspective view taken in the direction of the arrow at 5 in FIG. 4, but showing a blade in lowered or operative position.
Figure 6:
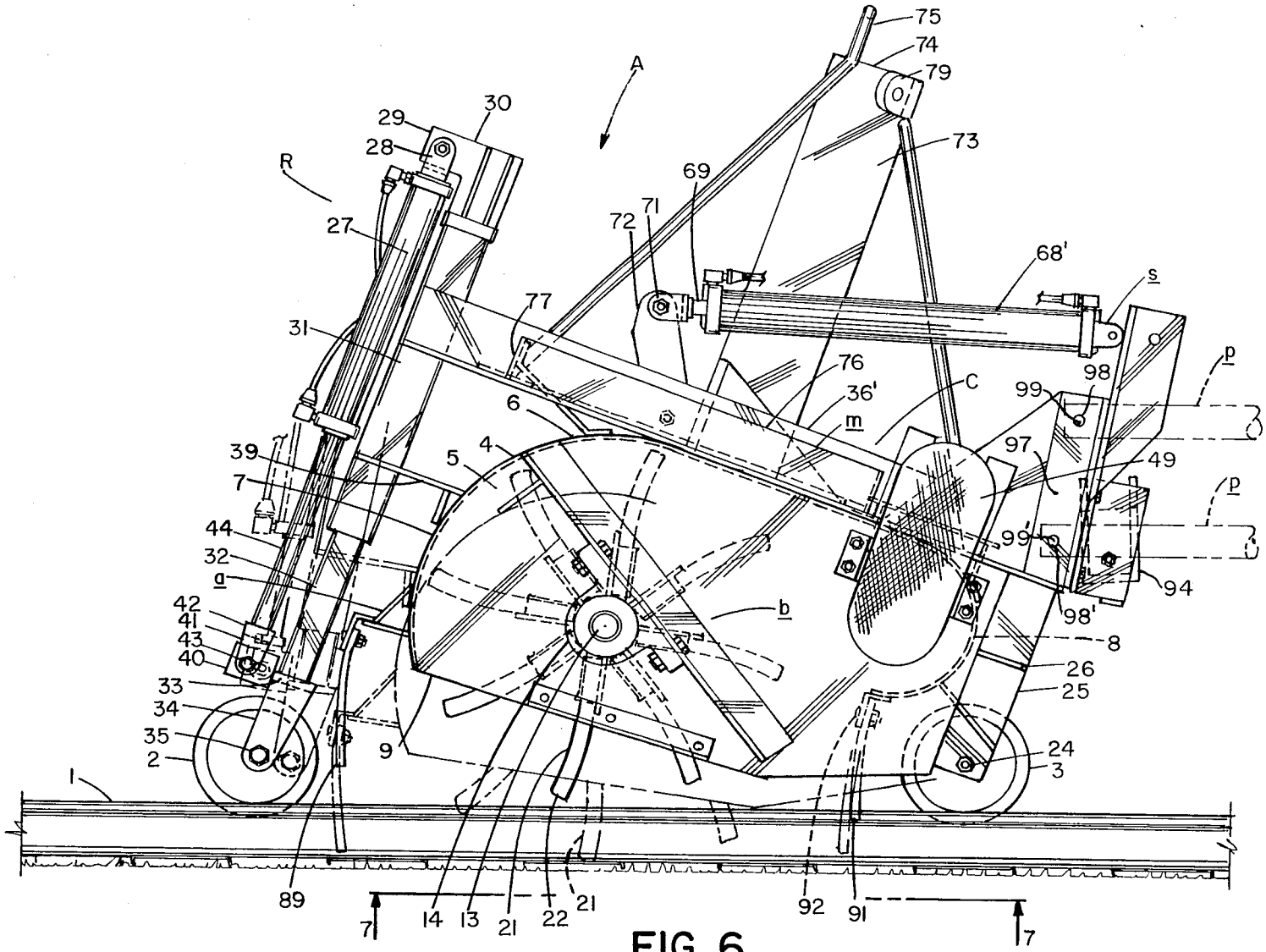
FIG. 6 is a side elevational view taken substantially on the line 6—6 of FIG. 3, but with the blade being removed and illustrating the broom in raised position in solid lines and in lowered or operative position in phantom lines, illustrating the interconnecting pipes in position for elevation of the cleaner.
Figure 8:
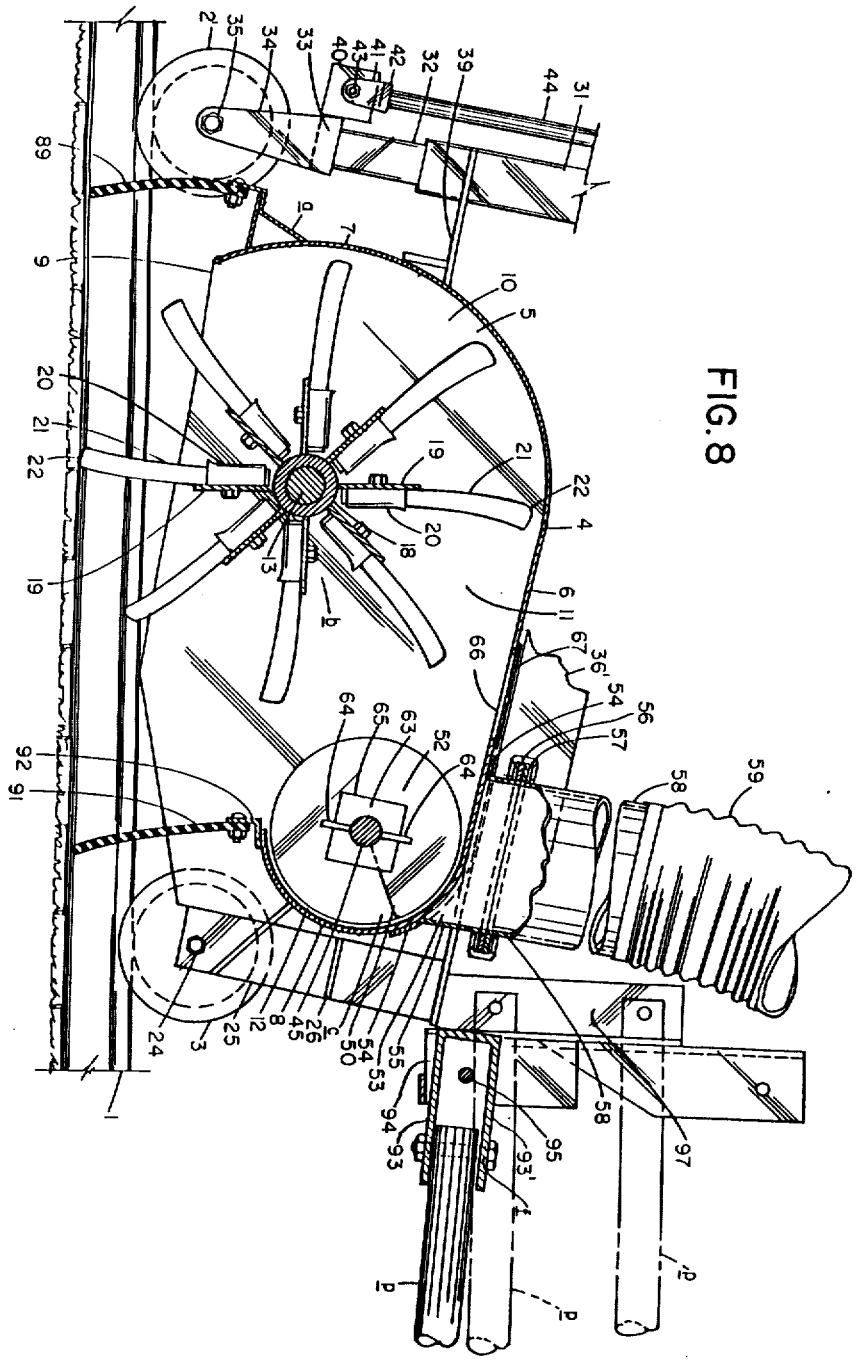
FIG. 8 is a vertical transverse sectional view taken on the line 8—8 of FIG. 7, showing, in full lines, the pipe interconnecting the vehicle and the cleaner for running purposes, and showing the pipes in phantom lines for elevation of the cleaner into rasied condition.

With reference to FIGS. 4, 5 and 6, it will be seen that housing 4 together with frame C, is adapted for rockable movement between upper or inoperative position as shown in full lines in FIG. 6 wherein broom assembly b is removed from contact with the bed being treated, and lower or operative position as shown in phantom lines in said Figure, in which latter position, as illustrated in FIG. 8, the lowermost plate 19 will present the related broom members 21 into engagement with the road bed. The pivot axis for such movement is coincident with axle-forming bolts 24, 24' passing through the hubs of rear wheels 3, 3', respectively; said bolts 24, 24' each being engaged to the lower ends of vertically extending paired mounting plates 25, 25' welded to housing rear wall 8, in dependency therefrom and being reinforced by gusset plates, as generally indicated at 26. The means for pivotal movement of housing 4 is indicated generally at R, which is constituted of a pair of fluid cylinders 27, 27' are disposed at opposite sides of frame C at the forward end thereof. Since said cylinders 27, 27', together with the associated structure, are identical, description will be restricted to cylinder 27 and the interconnected components. With reference to FIG. 6, it will be seen that cylinder 27 is engaged at the upper end thereof as by a clevis 28 to the forward extension 29 of a generally L-shaped plate 30; which latter is rigidly mounted on the upper end of a tubular casing 31 which may be of four-sided character. Said casing 31 is disposed in axially parallel relationship to cylinder 27 and projects downwardly therebeyond, being opened at its lower end, for slidably receiving an axially reciprocal, complementarily formed, arm 32. The lower end of arm 32 is fixed to a plate 33 having depending inner and outer flanges 34, 34' for supporting an axle-forming bolt 35 for the related front wheel 2, 2', as the case may be.

Casing 31 is fixed, as by welding, in the upper portions thereof, and on either side, to the forward end portions of longitudinally extending inner and outer frame beams 36, 36', as of angle stock, which are spaced apart to define an upwardly opening, intervening, narrow co-extensive recess r. Said beam pairs are secured to top plate 6 of housing 4, as by welding. Extending between inner beams 36, spacedly from the forward ends thereof, is a frame cross member 38 for rigidifying purposes. Casing 31 is also reinforced by connection to housing front wall 6 by a plurality of gusset plates broadly indicated at 39. Secured on plate 33 and projecting forwardly thereof, is a short mounting arm 40 embraced by the legs 41 of a clevis 42 and engaged thereto as by bolts 43. Clevis 42 is rigid at the lower end of a piston 44 axially moveable with respect to the associated cylinder 27. Accordingly, it will be seen that by manipulation of controls (not shown) for a motor and a pump (not shown) all of which are of conventional character, piston 44 may be extended or retracted with responsive movement of arm 32 and frame C. With piston 44 in retractive position (see phantom lines in FIG. 6), housing 4 is in downwardly rocked, lower or operative position; and when in extended state, as shown in full lines in FIG. 6, housing 4 is in upwardly rocked or in inoperative position wherein broom members 21 are removed from contact with the railroad bed so that cleaner A may be caused to travel to the working area without broom-ground engagement. It will be observed that arms 32 are retracted or extended in correspondence to movement of the associated pistons 44.

Figure 7:
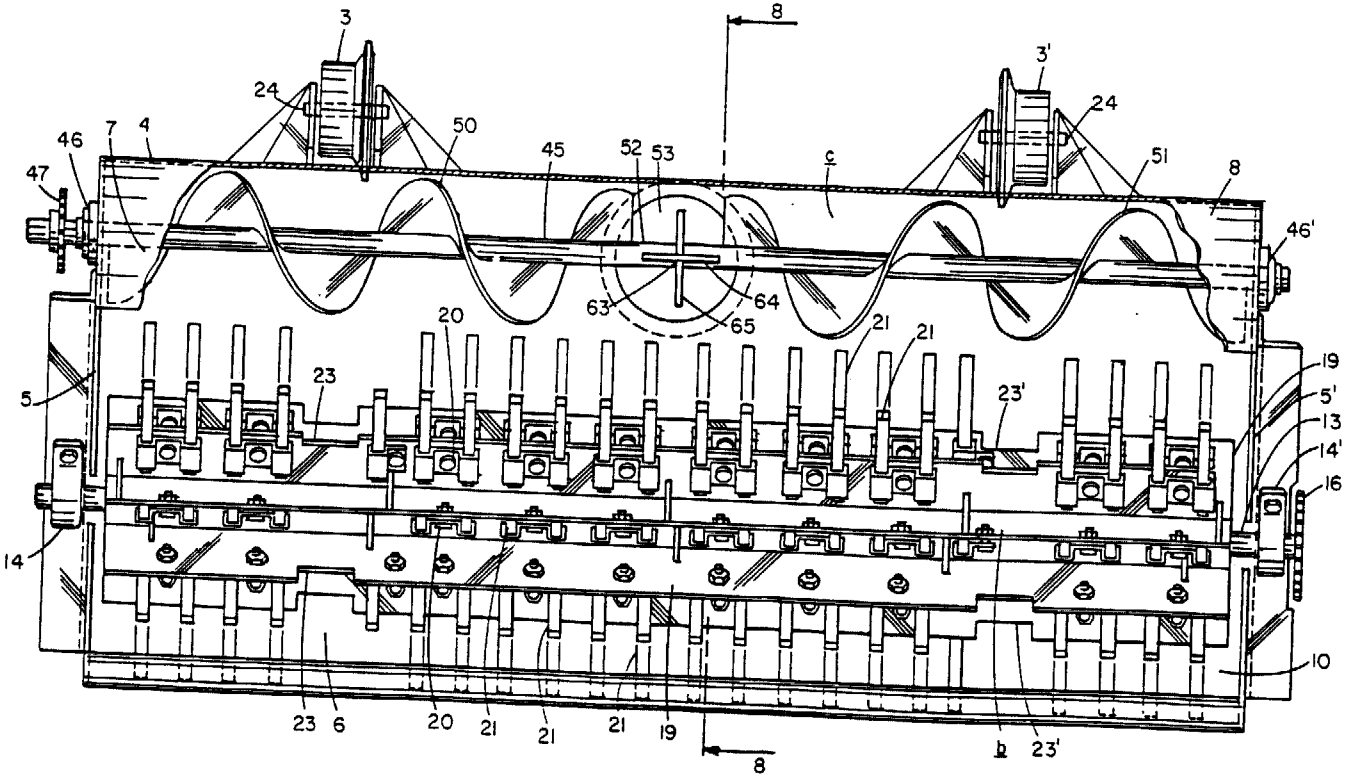
FIG. 7 is a bottom view of the broom and screw conveyor as seen substantially on the line 7—7 of FIG. 6 but with the housing portion for the screw conveyor being partially broken away.

With reference now being particularly made to FIGS. 7 and 8, it will be seen that debris feed conveyor c is of the rotary screw or auger type comprising a shaft 45 extending transversely of housing 4 in the rearward upper portion thereof, with said shaft 45 being axially parallel to broom shaft 13, but upwardly and rearwardly thereof. Shaft 45 projects at the end thereof through housing side walls 5, 5' for journalling for rotation within bearings 46, 46' suitably mounted upon said side walls 5, 5', respectively. Shaft 45 extends beyond bearing 46' for carrying a sprocket 47 about which is trained a transmission chain (not shown) for connection to the drive shaft (not shown) of a hydraulic motor 48 mounted suitably upon frame C; it being noted that said sprocket 47, together with the associated transmission chain and drive sprocket (not shown) are encased within a guard 49. Internally of housing 4, said shaft 45 carries a pair of cooperating screw conveyors 50, 51, the convolutions of the blades of which are arranged so that each will move contacted material inwardly toward the central portion of such conveyor. However, it is to be observed that each of said conveyors 50, 51 at the inner ends thereof terminate so as to define a central spacing 52 therebetween. Provided within top plate 6 of housing 4, immediately above, and aligned with, spacing 52, there is provided an opening or debris discharge port 53 of generally circular configuration. It will be seen that rear wall 8 is arcuated for conforming to conveyors 50, 51. Fixed upon top wall 6 by means of welding or the like is the base flange 54 of an upstanding short tubular section 55 aligned with, and of like internal diameter or cross section as, opening 53. Tubular section 55, at the upper end thereof, spacedly above top wall 6 is provided with a peripheral flange 56 upon which is secured a mating flange 57 on the lower forward end of a collar 58 of a flexible duct or tube 59 which extends upwardly and thence rearwardly above the hood h of automotive vehicle B for connection to rigid pipe sections 60 which progress rearwardly for communication with a hopper 61 provided upon propelling vehicle B. Duct 59, which is of conventional construction is suitably connected to a vacuum (not shown) carried on vehicle B, and broadly indicated at V, also of conventional design, for drawing, as by suction, debris and like materials therethrough from cleaner housing 4 for deposit within hopper 61. Supported upon vehicle B, rearwardly of hopper 61, and operably related thereto, may be a conveyor 62 which extends upwardly and thence rearwardly for conveying material received from hopper 61 for ultimate disposition. Conveyor 62 may be adapted for swingable movement so as to discharge received material to either side of the right of way being treated, if desired. But clearly, conveyor 62 does not form a part of the present invention, and, at best, is nothing more than an optional expedient.

Centrally of conveyor shaft 45, within the spacing 52 between conveyors 50, 51, and beneath opening 53, is a so-called flipper or debris impeller 63 which is comprised of flat, relatively thin plates 64, 65, in general cruciform relationship and rigid on shaft 45. The plane of plate 64 is aligned with the axis of shaft 45 while the plane of plate 65 is perpendicular thereto. Said plates 64, 65 are of greater cross section than the diameter of shaft 45 so as to extend in all directions therebeyond within the related plane. It is, of course, understood that said plates 64, 65 may be constituted of a plurality of cooperating components welded to shaft 45.

Figure 2:
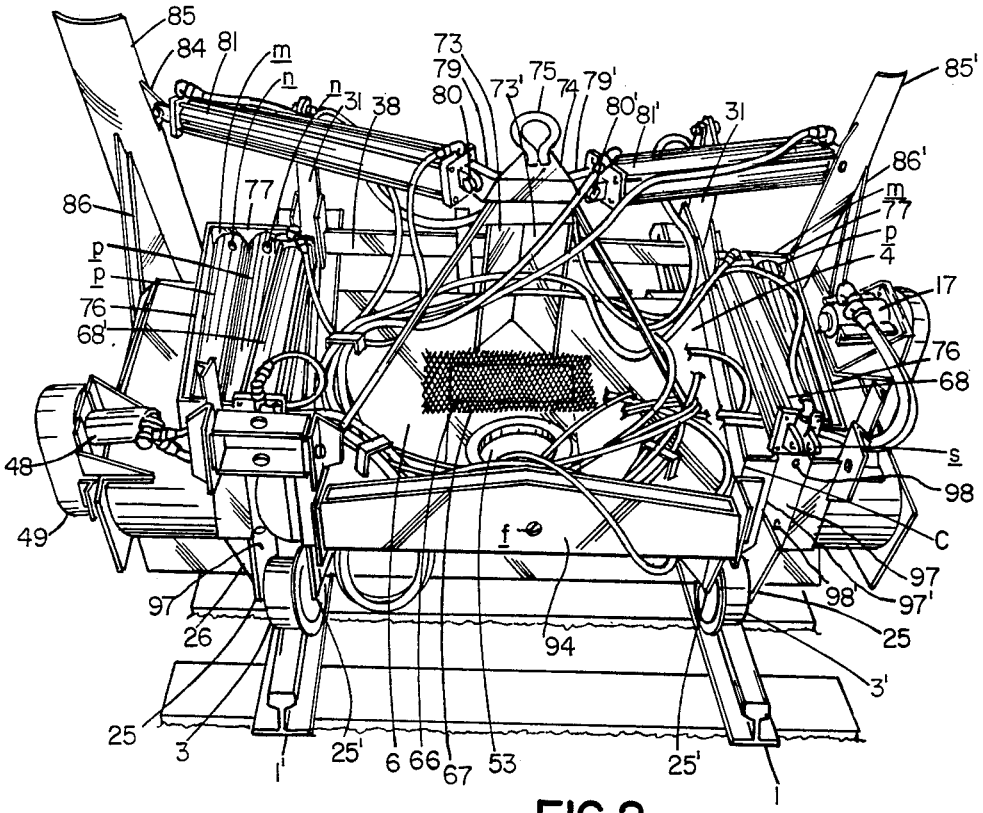
FIG. 2 is a perspective view looking down on the cleaner in the direction of the arrow at 2 in FIG. 1.

Forwardly of opening 53, top plate 6 is provided with an aperture or air inlet port 66 preferably provided with a mesh-type covering 67, as of expanded metal. As shown in FIG. 2, aperture 66 may be of any suitable configuration, but is shown as being four-sided with its longest dimension extending transversely of frame C. The area of aperture 66 is substantially comparable to the area of opening 53.

Provided on frame C upwardly of housing top wall 6 and on opposite sides thereof, are rearwardly and upwardly directed fluid cylinders 68, 68' having pistons 69, 69', respectively, which latter when extended, cause cylinders 68, 68' to project rearwardly of, and beyond, cleaner A for optional engagement at the rearward ends, as by bolts (not shown) passing through a carried clevis s and aligned openings t in opposed, vertically disposed, channel members 70, 70' fixed on the forward end of vehicle B. The forward ends of pistons 69, 69' are each engaged as by a clevis 71, to the upper end of a forwardly canted arm 72 welded to top wall 6 within the related recess r of the associated frame beams 36, 36'. Pistons 69, 69' with the respective cylinders 68, 68' when connecting cleaner A and vehicle B permit elevation or lifting of cleaner A from rail engagement, upon retraction of pistons 68, 68' for purposes, and in a manner, to be discussed more fully hereinbelow.

Mounted upon top plate 6 immediately forwardly of aperture 66 is a pair of vertically-extending support plates 73, 73' in V-formation with the apex of the "V" being directed forwardly substantially along the longitudinal center line of cleaner A. Mounted upon the upper ends of said plate 73, 73' is a horizontally disposed, rigid cap-like member 74 on which is fixed an upwardly extending enlarged eyelet 75. By utilization of chains, or like means, extending through said eyelet 75 and connected to a suitable hoisting apparatus (not shown), cleaner A, when disengaged from vehicle B may be easily lifted for transport to any desired location; as, for example, through disposition upon another vehicle or trailer. Provided on housing top wall 6 by side and end pieces, 76, 77 is a pair of laterally spaced apart, upwardly opening traylike receptacles m as a repository for a pair of pipe sections p; each having diametrally aligned openings, as at n, at each end thereof, for purposes presently appearing.

Figure 3:
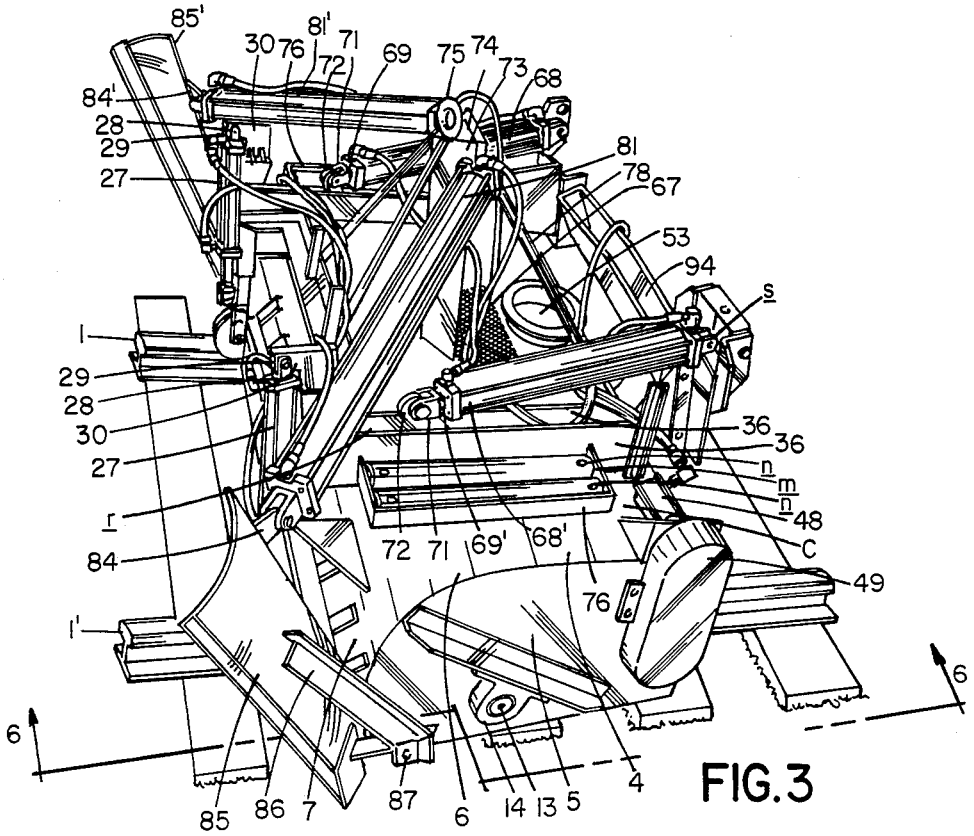
FIG. 3 is a perspective view of the left-hand side of the cleaner taken in the direction of the arrow at 3 in FIG. 1.

A pair of struts or braces generally indicated at 78, being preferrably four in number, connect cap 74 with front and rearward portions of frame C to reinforce said cap and the underlying structure so that no inadvertent developments occur during raising, lowering, or rocking of cleaner A by reason of any hoist connected through eyelet 75. Integral with cap 74, as by welding, is a pair of short arms 79, 79' which extend laterally and forwardly on opposite sides thereof for engaging clevises 80, 80', respectively, provided at the ends of fluid cylinders 81, 81', respectively. With reference to FIGS. 2 and 3, it will be seen that said cylinders 81, 81' are thus disposed so that the axes thereof form an acute angle with the longitudinal center line of cleaner A forwardly of cap 74. It will be further observed that cylinders 80, 81 extend both laterally forwardly and slightly downwardly.

Each cylinder 81, 81' accomodates a piston 82, 82', respectively, (see FIG. 5) which, when extended, progress laterally downwardly and forwardly with the outer or cylinder-remote end thereof terminating at a predetermined distance from the proximate rail 1 or 1', as the case may be. The outer end of each piston 82, 82' mounts a clevis 83, 83', respectively, for swingable engagement to a connecting arm 84, 84', respectively provided on the rearward upper outer end surface of a sweeper blade 85, 85', respectively. Fixed on the rearward face of each blade 85, 85', at the normally upper or outer end thereof, is an elongated reinforcing member, 86, 86' which extends beyond the normally lower or inner end of blade 85, 85', respectively, for pivotal engagement to a component, as indicated generally at 87, 87' upon frame C at its lower forward end portion, whereby said blades 85, 85' may be swung downwardly upon extension of the associated piston 82, 82' into operative position for sweepingly engaging the ground adjacent, but laterally outwardly of, rails 1, 1'. By reason of the disposition of cylinders 81, 81', together with the point of securement of pistons 82, 82' and the location of the respective pivot points, blades 85, 85' when in lowered, operative position, will be axially inclined with respect to the direction of travel of cleaner A for directing contacted debris, material or the like into the path of broom assembly b. Thus, blades 85, 85' serves to enhance markedly the area being treated by cleaner A assuring that the rail bed both between, and beyond, rails 1, 1' is swept. Upon retraction of pistons 82, 82', blades 85, 85' are swung upwardly about the pivoted lower or inner ends thereof into raised or inoperative position (see FIGS. 2, 3, and 4) so as to be in an optional inoperative state.

Secured to the forward lower end of housing 6 as by welding, is a plurality of horizontally spaced apart, forwardly extending arms a, which are fixed to a transversely extending mounting bar 88 having a plurality of bolts for supporting a depending groundengaging sealing strip or guard 89 fabricated of tough, flexible material, such as rubber, or a suitable synthetic. Said guard 89 thus on its lower edge engages the rail bed so that debris and dust is prevented from escaping the action of broom mebers 21 while also conducing to the confinement of the volume developed by housing A to assure that the suction of the vacuum will operate efficiently. It will be seen that guard 89 is provided on opposite sides with cut-away portions 90, 90' for clearance of rails 1, 1' during cleaner movement.

A companion sealing strip or guard 91 is provided at the lower rearward end of housing 6 with the same depending from a bar, as of angle shape, at 92, which extends between, and is fixed at its ends to, side walls 5, 5'. Thus, as indicated, guards 89, 91 serve as extensions of the related walls of housing 6 to conduce to the efficiency of the cleaning operation.

Before describing the operation of cleaner A which may be quite apparent from the foregoing, it is of course understood that the various fluid lines or hoses for the various fluid cylinders as hereinabove described are suitably connected to fluid sources and related motors and pumps within the vehicle A. Said fluid lines or hoses thus may be easily connected or disconnected so that cleaner A may be readily assembled into operative state or disassembled therefrom in minimum time. Accordingly, the operation of the various cylinders upon cleaner A will be effected by the operator within the auto vehicle cab.

With vehicle B and cleaner A in operative relationship, as shown in FIG. 1, the same will be interconnected by a single pipe section p; the forward end of which is connected to cleaner A by means of a bolt f extending through the aligned openings n at the forward end of the particular pipe section p (as shown in full lines in FIG. 8) and registering openings formed in the side walls 93,93' of a normally upwardly directed U-shaped transverse frame member 94 provided at the rearward end of the cleaner frame C and being adapted for pivotal movement as by pivot pins 95 provided at opposite ends thereof for interconnection with adjacent portions of the frame C. Thus, transverse member 94 will be normally in upwardly opening position, as shown in FIG. 2, but may be swung downwardly and rearwardly for opening toward the rear, as shown in FIG. 8. The engaged pipe section p at its rearward end is interconnected by a bolt f' to vertically spaced-spart transverse elements 96,96' extending between the pairs of channel members 70,70' on the forward end of the vehicle B. Thus, said pipe p provides the sole means of interconnection for driving purposes between vehicle B and cleaner A, and by the relatively loose fit of bolts f,f' permits mutual swingability for accommodating curves in the right of way being traveled. It is obvious that bolts f,f may be easily removed so as to effect disconnection.

With reference being made particularly to FIGS. 2, 6 and 8, it will be seen that laterally outwardly, on opposite sides, of the points of pivotal securement of transverse member 94, frame C is provided with vertically disposed, spaced-apart parallel plates 97,97' which contain upper and lower aligned openings, as at 98,98'. Each set of plates 97,97' will accommodate therebetween a pair of pipe sections (see FIGS. 6 and 8 in phamtom lines) which, at their forward ends, are pivotally connected, as by means of bolts 99,99' within the associated openings 98,98'. Each pair of pipes p is connected within the aligned channel members 70,70' at the forward end of vehicle B, with the associated bolts 99' passing through aligned openings in said channels, as at 100,101. Thus, the four pipe sections, two on each side, form a balanced interconnection between vehicle B and cleaner A, and with said pipes being loosely mounted at both their forward and rearward ends by the loose fit of the associated bolts. It is to be understood that in this relationship there is no pipe section connected to the transverse elements 96,96'. Then the cylinders 68,68' are caused to be extended so that the respective clevices s will project into the spaces between the aligned channel members 70,70' for interconnection thereto as by means of a fastening member (not shown) received within openings 102,102' in each of said channel members 70,70' Cleaner A, therefore, has, what might be referred to as, a six-point connection to cleaner B in this context, that is, three on each side through the forward ends of two pipes and the overlying fluid cylinder 68,68', as the case may be. The flexible vacuum duct 59 is disconnected and then the operator manipulates the fluid controls so a to cause the now extended pistons 69,69' of cylinder 68,68' to retract and in so doing will understandably draw cylinder A upwardly and toward vehicle B and as such retraction continues the same will ultimately effect a raising of the entire cleaner A from engagement with rails 1,1' with the swingable movement being facilitated by reason of the rocking of the associated pipe sections which thus assure balanced, even movement of the cleaner A into such elevated state. In this condition it is quite obvious that vehicle B is then able to travel with the raised cleaner A in a relatively rapid fashion for travel to the next working site on the particular roadbed being treated or for general transport purposes.

It is also to be recognized that in situations calling for travel over relatively greater distances, cleaner A is especially adapted for ease of portability. Thus, with vacuum duct 59 disconnected, as well as detachment of the single running pipe connection, cleaner A may be easily lifted by a suitable, conventional hoisting mechanism with a chain extending through eyelet 75 for transferring to a trailer or other mobile unit which may be hooked onto the rear of vehicle B or, if desired, for disposition upon an independent, self-motivated vehicle.

Cleaner A is peculiarly adapted for ease of portability and transfer which are properties entirely new in this art and quite incapable of ascription to the complex, heavy, primarily totally rail-supported track cleaning units of the prior art. Thus, for purposes of comparision, one could consider cleaner A to be simply an extended version of the typical household vacuum cleaner but, of course, adapted for railroad bed usage as opposed to normal household cleaning operations.

It would appear that the foregoing description would readily reveal the operation of the present invention but it will be seen that with cleaner A in running, attached condition to vehicle B, as shown in FIG. 1, when disposed at the beginning of the work site, the brush assembly and feed assembly will be properly caused to rotate through energization of the associated motors 17,48, respectively. The vacuum within vehicle B will be actuated so as to provide a drawing or air suction force upon the chamber 10 and the communicating compartments 11,12 thereof with the said guards 89,91 serving to confine the volumes of the same for enhancing the effectiveness of the vacuum. Broom assembly b is in lowered operative position (FIG. 8) by virtue of suitable disposition of cylinders 27,27' and, thus, will serve to brush the roadbed both between rails 1,1' and the portions immediately outwardly of said rails 1,1' causing travel of the contacted dirt, gravel, cinders, debris, etc. with dislodgement of partially grounded matter and direct same forwardly, thence rearwardly, for propulsion toward said conveyor c. It will be appreciated that the applied vacuum will assist the flow of such material in addition to the mechanical impelling movement achieved by broom assembly b. During this agitation caused by the said assembly b, guards 88,91 also serve to prevent the undesired displacement forwardly and rearwardly of housing 4 of such disturbed disbris into adjacent portions of the roadbed for causing necessity of further cleaning action.

By virtue of the configuration of conveyor c, the gravel, debris and the like received on the opposite side portions from broom assembly b will be necessarily directed toward the central spacing 52 for direct action thereupon of the drawing force of the vacuum being applied through the overlying duct 59 whereby such material will be drawn thereinto for delivery to hopper 61 for ultimate disposal.

Flipper or debris impeller 63 functions so as to receive against the surfaces thereof relatively enlarged debris particles, whether accepted directly through propulsion from broom assembly b or from the adjacent components of said conveyor c and serves to provide a fracturing surface for such particles to cause same to disintegrate into component pieces of relatively small size and thus conduces more readily to subjection to the vacuum force and be readily transferred via duct 59 to hopper 61. Flipper 63 thus assures that cleaner A will effectively remove from the treated roadbed debris of the particular size which has heretofore been incapable of effective removal by track cleaning equipment. Accordingly, by virtue of the inclusion of this novel device, cleaner A is able to accomplish a more thorough and lasting track cleaning operation than has been currently known. Withough flipper 63, such large particles would necessarily return, through gravity, to the roadbed and, thus, either be left thereon or removed in a costly manner by hand. Therefore, in view of the foregoing, it is quite obvious that cleaner A clearly constitutes a marked advance in the track cleaning art.

It is, of course, apparent that if desired the areas beyond the roadbed tie ends may be efficiently cleaned by utilization of sweeper blades 85,85'. The use of the same will, of course, be dictated by the condition of such areas and the same are easily operated. The requisite remote controls are manipulated so that the associated pistons 82,82' are extended to thereby present sweeper blades 85 in extended, ground-engaging disposition so that as cleaner A is moved the said blades will sweep the debris within the path of the same convergingly toward the areas subjected to the broom assembly b and be forced thereby toward conveyor c and, hence, along vacuum duct 59 for deposit. It has been found that said blades can cover a distance of 42" beyond such tie ends so that when considering such extent in conjunction with the roadbead per se, it will be appreciated that a most considerable area is concurrently being cleaned and restored to a fundamentally pristine condition.

It is obvious from the foregoing that the present invention is extremely utilitarian; is adapted for surprising portability or transportability, as well as being remarkably effective for roadbed treatment and being able to accomplish its intended purpose in a most economical fashion by utilization of a vacuum as the motivating force for debris removal; and which need not be self-motivated nor constructed as a component of a railway train but can be easily driven and guided by an automotive vehicle.

What is claimed is:

1. A railroad track cleaner consisting essentially of a frame, a pair of front and a pair of rear flanged rail-engageable wheels supporting said frame for rendering same traversable along the track being cleaned, a housing mounted on said frame and having a front wall, a top wall, parallel side walls, and a rear wall and being open at the lower end thereof for defining a downwardly open chamber, a rotary broom assembly mounted in said chamber for sweeping track debris, a debris feed conveyor provided in said housing rearwardly of said broom assembly, said feed conveyor comprising first and second components with an intervening spacing therebetween, said housing having a debris outlet opening located in the top wall of said housing above said intervening spacing, and an air inlet port provided in said top wall forwardly of said debris outlet opening.

2. A railroad track cleaner as defined in claim 1 wherein said broom assembly comprises a first shaft extending transversely of the housing, means journalling said shaft in said side walls, said shaft being located in the forward portion of the defined chamber, means engaging said broom assembly on said first shaft, and a plurality of individual broom members constituting said assembly and projecting radially of said first shaft being spaced about the circumference thereof, and means for vertically rocking said housing for causing said broom assembly to be in lowered, operative position with the broom members engaging the track to be cleaned and for elevating said broom assembly into upper or inoperative position wherein the broom members are removed from track contact.

3. A railroad track cleaner as defined in claim 1 wherein said broom assembly is located in the forward portion of said housing, and said feed conveyor is disposed in the upper rearward portion of said housing, said feed conveyor comprising first and second components being of screw or auger type and with the convolutions thereof arranged for directing received debris toward the intervening spacing, said spacing being located centrally of said feed conveyor, and material propelling means mounted on said feed conveyor within said spacing in underlying, aligned relation to said debris outlet opening.

4. A railroad track cleaner as defined in claim 3 wherein said material propelling means comprises first and second plates in mutual cruciform relation.

5. A railroad track cleaner as defined in claim 3 wherein said broom assembly comprises a first shaft extending transversely of said housing in the forward portion thereof, means mounting said broom assembly on said first shaft, said feed conveyor comprising a second shaft extending transversely of said housing in the rearward portion thereof being upwardly and rearwardly spaced from said first shaft and in axially parallel relationship thereto, means mounting said first and second screw or auger type conveyors on opposite end portions of said second shaft, and means fixing said material propelling means on said second shaft in vertical alignment with said debris outlet opening.

6. A railroad track cleaner as defined in claim 5 wherein said material propelling means comprises first and second plates fixed upon said second shaft in mutual cruciform relationship.

7. A railroad track cleaner as defined in claim 5 wherein said material propelling means comprises a first plate rigid on said second shaft and having the plane thereof perpendicular to the axis of said shaft, and a second plate rigid on said shaft in intersecting relationship to said first plate, the plane of said second plate being coincident with the axis of said second shaft.

8. A railroad track cleaner as defined in claim 7 wherein the respective planes of said first and second plates extend radially outwardly throughout the entirety of the engaged circumferential portion of said second shaft.

9. A railroad track cleaner as defined in claim 8 wherein the first and second plates are of general flat four-sided character with the opposite faces of said first plate being directed laterally of said housing toward the proximate respective ends of the first and second screw or auger feed conveyors, and the opposite faces of said second plate being directed toward the forward and rearward ends of said housing.

10. A railroad track cleaner as defined in claim 9 wherein the dimensions of said first and second plates are of predetermined extent for impingement thereon and deflection therefrom of relatively enlarged debris particles.

11. A railroad track cleaner as defined in claim 1 and further characterized by first and second laterally and forwardly extensible sweeping blades having upper and outer, and lower and inner ends, mechanical means pivotally engaging each of said blades in the lower or inner end portions thereof to said frame, and blade operating means connected to the upper or outer ends of each blade for causing pivotal movement of said blades between lowered or operative condition for sweeping the area adjacent the track being cleaned and upper or inoperative condition.

12. A railroad track cleaner as defined in claim 11 wherein said blade operating means comprises fluid cylinders mounted on opposite side portions of said frame, each cylinder having an extensible and retractable piston, and rockable means engaging each piston at the cylinder remote end thereof to the rearward or outer end portion of the associated blade.

13. A railroad track cleaner as defined in claim 12 wherein the pivotal mounting of the lower end of each blade is rearwardly and inwardly of the connection of the related piston so that said blades, when in lowered or operative position, will be directed forwardly and inwardly for sweeping debris toward the path of travel of said cleaner

14. In combination with an independent, mobile debris receptacle, a vacuum provided in said receptacle for drawing debris thereinto, of a railroad track cleaner comprising a frame, a pair of front and rear flanged rail-engageable wheels supporting said frame for rendering such traversable along the track being cleaned, a housing mounted on said frame and having a front wall, a top wall, parallel side walls, a rear wall, and being open at the lower end thereof for defining a downwardly open chamber, a rotary brush assembly mounted in said chamber for sweeping track debris, a debris feed conveyor provided in said housing rearwardly of said broom assembly, said feed conveyor comprising first and second components with an intervening spacing therebetween, said housing having a debris discharge outlet opening located in the top wall of said housing above said intervening spacing, an air inlet port provided in said top wall forwardly of said debris outlet opening, means interconnecting said debris outlet opening in said housing and said debris receptacle, and means detachably interconnecting said mobile debris receptacle and said track cleaner.

15. The combination defined in claim 14 and further characterized by said means connecting said debris discharge outlet and said debris receptacle being an elongated flexible conduit, and means securing said conduit at one end thereof to said frame in communication with said debris discharge outlet opening whereby the vacuum provides a debris withdrawing suction force to said housing chamber.

16. The combination as defined in claim 14 wherein said independent mobile debris receptacle comprises an automotive vehicle, a prime mover provided on said automotive vehicle for motivation thereof, said receptacle constituting a hopper carried on said vehicle, a vacuum provided with said hopper for drawing material thereinto, a flexible conduit connecting said hopper and said chamber housing through said debris discharge outlet opening of the latter, said means detachably interconnecting said mobile debris receptacle and said track cleaner being members extending between the rearward end of said track cleaner and said automotive vehicle.

17. The combination as defined in claim 16 and further characterized by said automotive vehicle being located rearwardly of said railroad track cleaner, and said means for detachably engaging said cleaner and said vehicle extending between the rearward end of said cleaner and the forward end of said vehicle, whereby the latter when engaged, pushes said cleaner from the rear thereof along the track being cleaned.

18. The combination as defined in claim 17 wherein the automotive vehicle contains supporting wheels with there being sufficient transverse spacing therebetween so that the vehicle will travel over the ground outwardly adjacent the track being cleaned.

* * * * *

UNITED STATES PATENT AND TRADEMARK OFFICE

CERTIFICATE OF CORRECTION

PATENT NO. : 4,741,072

DATED : May 3, 1988

INVENTOR(S) : Kenneth R. Wilkerson

It is certified that error appears in the above-identified patent and that said Letters Patent is hereby corrected as shown below:

IN THE DRAWINGS:

Please add Fig. 7 and Fig. 8 as shown on the attached sheets.

Signed and Sealed this

Twelfth Day of January, 1993

*Attest:*

DOUGLAS B. COMER

*Attesting Officer*

*Acting Commissioner of Patents and Trademarks*